United States Patent [19]

Brownell

[11] 3,993,970

[45] Nov. 23, 1976

[54] COAXIAL CABLE SWITCH

[75] Inventor: Richard Miller Brownell, Upper Arlington, Ohio

[73] Assignee: Bell Telephone Laboratories, Incorporated, Murray Hill, N.J.

[22] Filed: Oct. 23, 1975

[21] Appl. No.: 625,244

[52] U.S. Cl. ..... 335/5; 333/97 S; 335/152

[51] Int. Cl.[2] ..... H01H 51/27

[58] Field of Search ..... 335/5, 4, 152; 333/7 R, 333/97 S

[56] References Cited

UNITED STATES PATENTS 2,823,358 2/1958 Means et al. ..... 333/97 S

*Primary Examiner*—Harold Broome

*Attorney, Agent, or Firm*—William H. Kamstra

[57] ABSTRACT

A coaxial cable switch comprising a plurality of sealed reed, magnetically responsive switches serially connected in alternating directions which switches act as the inner signal path of a coaxial conductor. The outer coaxial conductor consists of a copper "corrugated" sheet within the adjacent and oppositely facing channels of which the individual switches are respectively positioned. The open sides of the channels are covered with metallic tape by means of a conductive adhesive and a single winding encircles the structure for the simultaneous operation of the reed springs.

5 Claims, 3 Drawing Figures

COAXIAL CABLE SWITCH

BACKGROUND OF THE INVENTION

This invention relates to electrical switch arrangements and more particularly to coaxial cable switches employing sealed reed contacts.

Switch arrangements in which electrical continuity in a coaxial transmission cable is controlled by a pair of reed contacts in series with the center conductor of the cable are well known in the art as is the problem of providing sufficient isolation when the contacts are open. One prior art switch construction directed to the latter problem is described in U.S. Pat. No. 3,355,684, issued Nov. 28, 1967, to D. S. Church et al., and provides for the serial connection of at least three spaced reed contact pairs in the center conductor of a coaxial cable. Open circuit isolation is thereby significantly improved while maintaining optimum closed circuit conduction characteristics. Although the arrangement described and contemplated in the afore-cited Church et al. patent provides for the serial positioning of the reed contacts along the same longitudinal axis, it is apparent and known that the reed contacts may be arranged in individual axes in a folded, "zig-zag" manner to achieve a more compact switch package as long as the contact spacing restraints defined are adhered to.

In the afore-cited Church et al. switch the reed contacts are serially connected in the inner conductor of a typical coaxial tubular outer conductor. As a result, when the contacts are closed by the energization of windings wound on the outer conductor, the switch construction does not differ substantially in form from the coaxial cable in which it is connected. In a known departure from the typical coaxial inner-solid, outer-tubular conductor switch construction, a single copper sheet is formed to present three adjacent channels within the two outer channels of which individual, electrically isolated reed spring contacts are placed. The reed spring contacts again comprise the inner conductors but here the enclosing copper channels comprise the outer conductors of two electrically distinct coaxial conducting paths. The contacts are operated by a winding about the entire construction and the inner channel conveniently offers an enclosure for a permanent magnet which may be employed to coact with the spring contacts. The "corrugated" copper sheet thus serves to isolate the two conducting paths. A readily fabricated, low cost, and compact switch construction is thus realized.

It is an object of the present invention to achieve high open-circuit isolation in a multiple reed spring coaxial switch construction which, by integrating outer conductor segments into a single unitary element, also achieves significant savings in materials, fabrication time, and manufacturing costs.

It is also an object of this invention to provide a new and novel coaxial switch construction which combines the advantages of multiple contact isolation and a unitary outer conductor element.

SUMMARY OF THE INVENTION

The foregoing and other objects of this invention are realized in one illustrative embodiment thereof comprising a plurality of sealed reed spring, magnetically responsive switches serially connected in alternating (zig-zag) fashion, which switches act as the inner signal path of a coaxial conductor. The outer path of the coaxial conductor comprises a copper "corrugated" sheet formed to present adjacent and oppositely opening channels within which the individual reed spring switches are respectively positioned. The open faces of the channels are covered by a suitable metallic tape by means of a conductive adhesive and a single winding encircles the assembly thus formed for the simultaneous operation of the reed springs.

In accordance with one aspect of this invention, the segments of the single signal path through the switch share portions of the structure forming the outer conductors. For example, in a three reed spring embodiment, the central signal path segment, as its outer conductor, shares the channel walls separating it from the adjoining outer signal path segments, which channel walls also form parts of the outer conductors for the latter path segments.

A coaxial switch construction according to this invention, featuring a single unitary structure which acts at once as a signal path completion means and as a mounting enclosure for the reed spring contacts advantageously offers a simple, low cost approach to meeting specific requirements of a coaxial switch in terms, not only of high, open circuit isolation, but also in achieving optimum impedance matching, low insertion loss, broad bandwidth, and minimum crosstalk.

BRIEF DESCRIPTION OF THE DRAWING

The objects and features of this invention will be better understood from a consideration of the detailed description of the organization and operation of one illustrative embodiment thereof which follows when taken in conjunction with the accompanying drawing in which.

DETAILED DESCRIPTION

Figure 1:
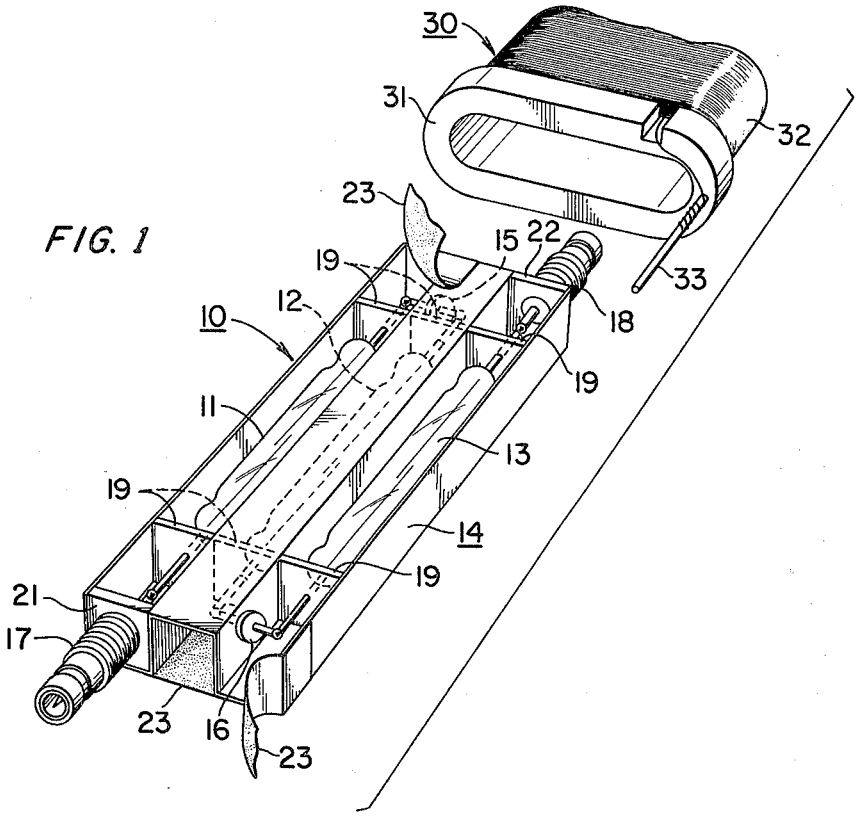
FIG. 1 depicts in three-quarter and exploded view a coaxial switch arrangement according to the principles of this invention with closure portions removed more clearly to show the relationship of its parts.
Figure 2:
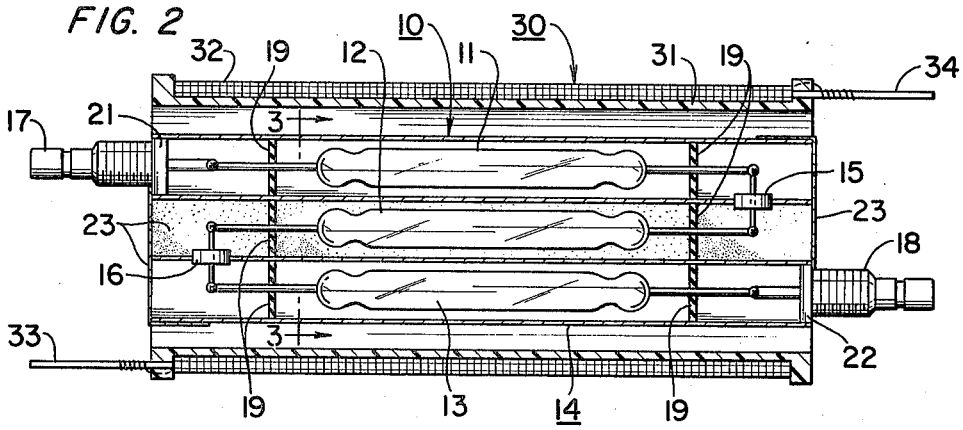
FIG. 2 is a cross-sectional view of the coaxial switch of FIG. 1 assumed as fully assembled taken along a plane parallel with its widest dimension.

As shown in FIG. 1 of the drawing, one illustrative coaxial switch arrangement according to this invention comprises a switch assembly 10 and a winding assembly 30, the latter being shown as removed from its normal assembled position encircling the assembly 10. The switch assembly 10 comprises a plurality of sealed reed spring relays 11, 12, and 13, the longitudinal axes of which are parallelly arranged. The relays 11. 12, and 13 are positioned respectively in the alternately open-faced channels formed by "corrugations" in a unitary element 14. The latter element may be stamped from a suitable blank of a conducting material such as, for example, copper. The relays are serially connected within their respective channels at their ends by means of feed-through fittings mounted in, and electrically insulated from the walls of the channels of element 14. Thus, relay 11 has one of its terminals connected to a corresponding terminal of relay 12 by means of a feed-through fitting 15 shown hidden in FIG. 1 and clearly shown in FIG. 2. Similarly, the other terminal of relay 12 is connected to a corresponding terminal of relay 13 by means of a feed-through fitting 16. The other terminals of relays 11 and 13 are connected, respectively, to the central conductors of conventional coaxial connectors 17 and 18. The channels of the corrugated element 14, as mentioned hereinbefore, comprise the outer coaxial conductors of which the reed springs of the relays comprise the inner conductors. To maintain the central positioning of the relays, insulated spacers 19 may conveniently be mounted within the channels of element 14 to hold the relay terminals. The connectors 17 and 18 make electrical contact with the element 14 at each end by means of conductive spacers 21 and 22.

Figure 3:
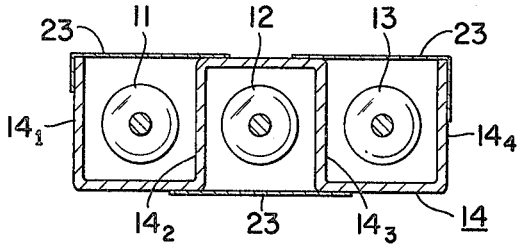
FIG. 3 is a second cross-sectional view of the coaxial switch of FIG. 1 taken along the line 3—3 of FIG. 2.

The channels of the corrugated element 14, which are open-faced prior to final assembly, are closed, in a completed assembly of the illustrative switch being described, by means of a metallic conductive tape 23 conveniently mounted to the element 14 by means of a conductive adhesive. The tape 23 is shown in FIG. 1 at only one of the upward facing channels and then as folded away more clearly to show the positioning of the relays 11 and 13. A similar tape 23 closes the open ends of the element 14, again shown in FIG. 1 at one end of the switch assembly as folded away. The end section view of FIG. 3 shows the tapes 23 fully closing the open faces of the channels to provide complete shielding for the inner signal path of the switch.

The relays 11, 12, and 13 may comprise any suitable, commercially available sealed contact devices having magnetic reed springs operated responsive to an applied magnetic field and need not be further described. As dictated by particular circuit contexts, the reed springs may be formed of a remanent magnetic material, for example, in order to operate as magnetically latching switches to eliminate the necessity of providing holding currents. Conductive tapes of the character contemplated for use in a specific switch according to this invention are also commercially available. One such tape commercially designated 3-M Type X-1181 is provided with a conductive adhesive backing and proved suitable in the practice of this invention.

The completed subassembly of the switch 10 is finally assembled by its fitting into the winding assembly 30. The latter conventionally comprises a bobbin 31 for carrying a winding 32 terminating at each end in winding terminals 33 and 34. The winding assembly 30 is shown in part in FIG. 1 and in section in FIG. 2 in place about the switch 10. Conventionally, the energization of the winding 32 by an applied current generates a magnetic field for the simultaneous operation of the reed spring contacts of the relays 11, 12, and 13. In an illustrative operative mode in which the relay contacts are normally open, their closure establishes a single inner conductor signal path through the switch. The outer conductor of the coaxial switch structure is formed by the corrugated element 14 including the channel walls $14_1$, $14_2$, $14_3$, and $14_4$ and the covering tapes 23, the coaxial relationships of which are best seen in the section view of FIG. 3. In the latter figure it is also clear that the signal path segments defined by the relays 11 and 13 share common channel walls $14_2$ and $14_3$, respectively, with the path segment defined by the relay 12. This economy of material is possible in view of the conductive characteristic of outer coaxial conductors which are manifested at the frequencies at which the switch of this invention is normally operated, say, on the order of 100 megahertz. At such frequencies, conduction in the coaxial outer conductor occurs largely near the inner surface of the conductor wall. As a result, no interference among the signal path segments occurs during the operation of a switch according to this invention.

A simple, readily fabricated specific coaxial switch arrangement embodying the principles of this invention has been described in the foregoing. Although no physical dimensions were indicated, in practice in one construction, the element 14 was formed of a copper sheet 0.005 inches thick to present channels having a width and depth of approximately 0.2 inches. The width and/or depth may be suitably varied for particular circuit applications to control the impedance of the switch. Other modifications and variations of structure may be introduced in the practice of this invention. Thus, for example, instead of a corrugated sheet formation, the element 14 may, by extrusion or other process, be formed as a flat back plate having the channel walls $14_1$-$14_4$ extending perpendicularly therefrom. A single tape 23 may then be employed to cover the plurality of channel openings. The element 14 may also be formed to present rounded or circular channels should these be more convenient. It will also be appreciated that more than three channels may be provided in the element 14 to accommodate additional relays as dictated by circuit application needs.

what has been described has thus been only one specific coaxial switch construction according to the principles of this invention and various and numerous other arrangements in addition to those suggested in the foregoing may be devised by one skilled in the art without departing from the spirit and scope of the invention as defined by the accompanying claims.

What is claimed is:

1. A coaxial cable switch construction comprising a conductive member formed to present a plurality of open-faced adjacent channels, the inner ones of said channels sharing common walls, a plurality of magnetically responsive relay means positioned respectively in said channels, means for electrically connecting alternating terminals of adjacent ones of said relay means to form a series combination, and electrically conductive means for closing said open-faced channels.

2. A coaxial switch construction as claimed in claim 1 in which said electrically conductive means comprises a flexible metallic tape adhesively bonded to said conductive member.

3. A coaxial switch construction as claimed in claim 1 in which said conductive member comprises a sheet formed so that the open faces of said adjacent channels alternate on opposite sides of said sheet.

4. A coaxial switch construction as claimed in claim 1 also comprising a winding means magnetically coupled to said plurality of relay means energizable for operating said plurality of relay means.

5. A coaxial switch construction as claimed in claim 4 in which said winding means encircles said conductive member.

* * * * *